US009033808B1

(12) United States Patent
Barenie

(10) Patent No.: US 9,033,808 B1
(45) Date of Patent: May 19, 2015

(54) TEETER TOTTER APPARATUS

(71) Applicant: Paul Barenie, Schererville, IN (US)

(72) Inventor: Paul Barenie, Schererville, IN (US)

( * ) Notice: Subject to any disclaimer, the term of this patent is extended or adjusted under 35 U.S.C. 154(b) by 13 days.

(21) Appl. No.: 13/815,385

(22) Filed: Feb. 27, 2013

(51) Int. Cl.
*A63G 11/00* (2006.01)
*A63B 21/16* (2006.01)

(52) U.S. Cl.
CPC ..... *A63G 11/00* (2013.01)

(58) Field of Classification Search
CPC ..... A63G 1/00; A63G 1/12; A63G 1/32; A63G 11/00; A63B 21/16; A63B 21/28
USPC ..... 472/4, 5, 106, 109, 111, 112
See application file for complete search history.

(56) References Cited

U.S. PATENT DOCUMENTS 1,552,841 A * 9/1925 Hector ..... 472/4
2,564,146 A * 8/1951 Bouchard et al. ..... 472/4
3,813,702 A * 6/1974 Diemond et al. ..... 4/494
4,544,201 A * 10/1985 Rogers, Jr. ..... 297/259.2
4,971,313 A * 11/1990 Hucks ..... 472/81
5,795,235 A * 8/1998 Ullrich et al. ..... 472/14
5,951,406 A * 9/1999 Steane ..... 472/111

* cited by examiner

*Primary Examiner* — Kien Nguyen
(74) *Attorney, Agent, or Firm* — Paul Barenie, esq.

(57) ABSTRACT

A teeter totter apparatus comprises a base portion, a caster assembly including a caster base portion having a plurality of caster base holes for fixing the caster base portion to the base portion, and a caster yoke portion rotationally coupled with the caster base portion allowing rotation of the caster yolk portion about a first axis. A beam portion coupled with the caster yolk portion includes at least one seating portion and is capable of being fixed to the caster yolk portion while allowing the beam portion to rotate about a second axis. In another aspect, a teeter totter apparatus includes a seating portion and opposing seat adjustment portion that sandwich the beam and allow the seat portion to be adjusted in position along the beam. In another aspect, a lazy Susan rotational bearing coupled between the base and yolk portions provides the rotational capabilities for the apparatus.

11 Claims, 11 Drawing Sheets

TEETER TOTTER APPARATUS

CROSS-REFERENCE TO RELATED APPLICATIONS

This patent document claims the benefit of the filing date under 35 U.S.C. §120 of U.S. patent application Ser. No. 13/066,440 entitled "Teeter Totter Apparatus" to Paul Barenie, that was filed on Apr. 14, 2011, the contents of which are hereby incorporated by reference herein.

TECHNICAL FIELD

This invention is directed to play equipment, and more particularly, to a teeter totter apparatus.

BACKGROUND ART

Teeter totters, or see-saws as they are sometimes referred, provide enjoyment for young and old. In operation, a rider is seated at each end of a teeter totter beam, that rotates about an axis of a pivot/fulcrum point. Each rider alternately exerts an upward force to cause their respective end of the beam to elevate, while the opposite end of the beam lowers toward the surface on which the teeter-totter is situated (typically the ground).

In some circumstances, additional movement is desired by the riders of a teeter totter. However, traditional teeter totters do not allow additional movement, and are restricted to rotation about the pivot/fulcrum.

In some circumstances, the weight of the teeter totter users are different. In such cases, it is often more challenging for the heavier of the riders, as the heavier rider must push harder to cause his/her end of the teeter totter to elevate, and must absorb a great force as his/her end of the teeter totter lowers to the ground. Where the weight differential between the riders is too great, utilization of the teeter totter becomes difficult if not impossible. To help to alleviate this problem, an adjustable seat has been used, where the seat includes a portion extending down and even with the sides of the teeter totter. The downward extending seat portion includes a hole, and the side of the beam includes predrilled holes along its length. A user adjusts the seat by aligning the hole in the downward extending portion of the seat with one of the holes along the teeter totter beam, and placing a bolt through the aligned holes to lock the teeter totter seat at that position. However, alignment of the holes of the downward extending portion of the seat with those of the beam can be difficult for riders, as even a slight misalignment can prevent insertion of the bolt to lock the seat in place. Further, if a substantial balance point exists between any two of the holes along the teeter totter beam, it may be difficult for the riders to achieve balance from the provided holes.

This invention is directed to solving one or more of the problems discussed above.

DETAILED DESCRIPTION OF THE PREFERRED EMBODIMENT

Figure 1:
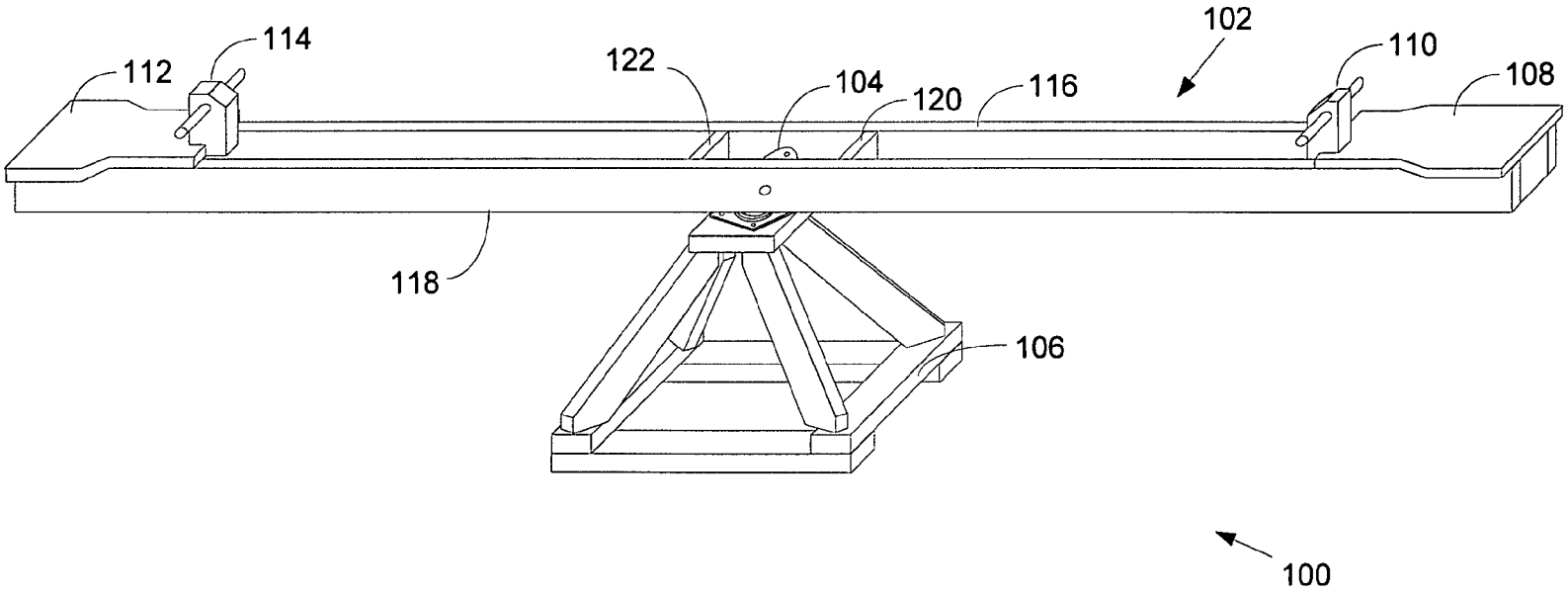
FIG. 1 illustrates a perspective view of an exemplary teeter totter apparatus, in accordance with an embodiment of the invention.

A teeter totter apparatus comprises a base portion, and a caster assembly coupled with the base portion and including a caster base portion, and a caster yoke portion rotationally coupled with the caster base portion about a king pin, allowing rotation of the caster yolk portion about a first axis, the caster yoke including a first and second substantially parallel yoke side portions including respective first and second caster yoke pivot pin holes. A beam portion includes at least one seating portion and at least one beam hole, the at least one beam hole capable of being aligned with the first and second caster holes through which a pivot pin is placed, fixing the beam portion to the caster yolk portion while allowing the beam portion to rotate about a second axis. The beam portion includes a friction reduction portion integrated at an underside of at least one end of the beam portion, the friction reduction portion comprising a curved surface, thereby reducing the friction between the beam portion and a surface on which the base portion rests when the beam portion contacts the surface while it is rotating about the first axis.

In another embodiment, the teeter totter apparatus includes an opposing seat adjustment portion and a contracting mechanism, where the contracting mechanism couples the seat portion with the opposing seat portion and sandwiches the beam portion between the seat portion and the opposing seat adjustment portion. When the contracting mechanism is in a loose state, friction is reduced between the seat portion, the opposing seat adjustment portion and the beam portion, thereby allowing the seating portion to be moveable along the beam portion, and when the contracting mechanism is in a taught state, the seat portion and the opposing seat adjustment portion are frictionally secured against the beam portion to prevent the seat portion from movement along the beam portion.

In another aspect, a teeter totter apparatus comprises a base portion, a beam portion coupled with the base portion, at least one seating portion and an opposing seat adjustment portion. A contracting mechanism couples the seat portion with the opposing seat adjustment portion, thereby sandwiching the beam between the seat portion and the opposing seat adjustment portion. When the contracting mechanism is in a loose state, friction is reduced between the seat portion, the opposing seat adjustment portion and the beam portion to allow the seating portion to be moveable along the beam, and when the contracting mechanism is in a taught state, the seat portion and the opposing seat adjustment portion are frictionally secured against the beam to prevent the seat portion from movement along the beam.

In accordance with another aspect of the invention, a teeter totter apparatus includes a base portion, and a lazy susan rotational bearing coupled with the base portion. A yoke portion is coupled with the lazy susan rotational bearing portion and includes a pivot portion. A beam portion is coupled with the yoke portion at the pivot portion, and includes at least one seating portion, and a friction reduction portion integrated at an underside of at least one end of the beam portion, the friction reduction portion comprising a curved surface, thereby reducing the friction between the beam portion and a surface on which the base portion rests when the beam portion contacts the surface while it is rotating about the first axis.

FIG. 1 illustrates a perspective view of an exemplary teeter totter apparatus 100, in accordance with an embodiment of the invention. As shown in FIG. 1, the teeter totter apparatus 100 includes a beam 102 on which riders may be situated, that is coupled with a caster assembly 104. The caster assembly 104 is further coupled with a base 106.

The beam 102 may include a seat 108 on one side of the teeter totter beam, shown here at one end of the teeter totter beam 102, where the seat may further include a handle 110. The beam 102 may further include a seat 112 on the other side of the beam 102, shown here at the opposite end of the beam 102. The seat 112 may include a handle 114. It will be appreciated that although the seats 108 and 112 are shown at the end of the teeter totter, they need not be placed at the end, and may instead be situated anywhere along their respective side of the beam 102.

As shown in the embodiment shown in FIG. 1, the beam 102 may comprise a pair of parallel runners, with a first parallel runner 116 and a second parallel runner 118, coupled by a first cross member 120 and a second cross member 122. The parallel runners 116 and 118 may be coupled with the cross members 120 and 122 using, for example, screws (not shown). For example, two screws (not shown) may be utilized to secure each side of a cross member to a parallel runner of the beam. Further, the seats 108 and 112 may be coupled with the beam 102 using for example, screws (not shown). The screws may be, for example, standard screws, coated deck screws (coated with a coating to help resist weather), galvanized deck screws, and/or stainless steel screws, as will be appreciated by one skilled in the art, with for example flat, phillips, square or star/torque head configurations. The handles 110 and 114 may be coupled with their respective seat using, for example, lag screws (for example, zinc or otherwise coated), or screws such as the screws described above. The handles 110 and 114 are discussed further below, in more detail.

Figure 2:
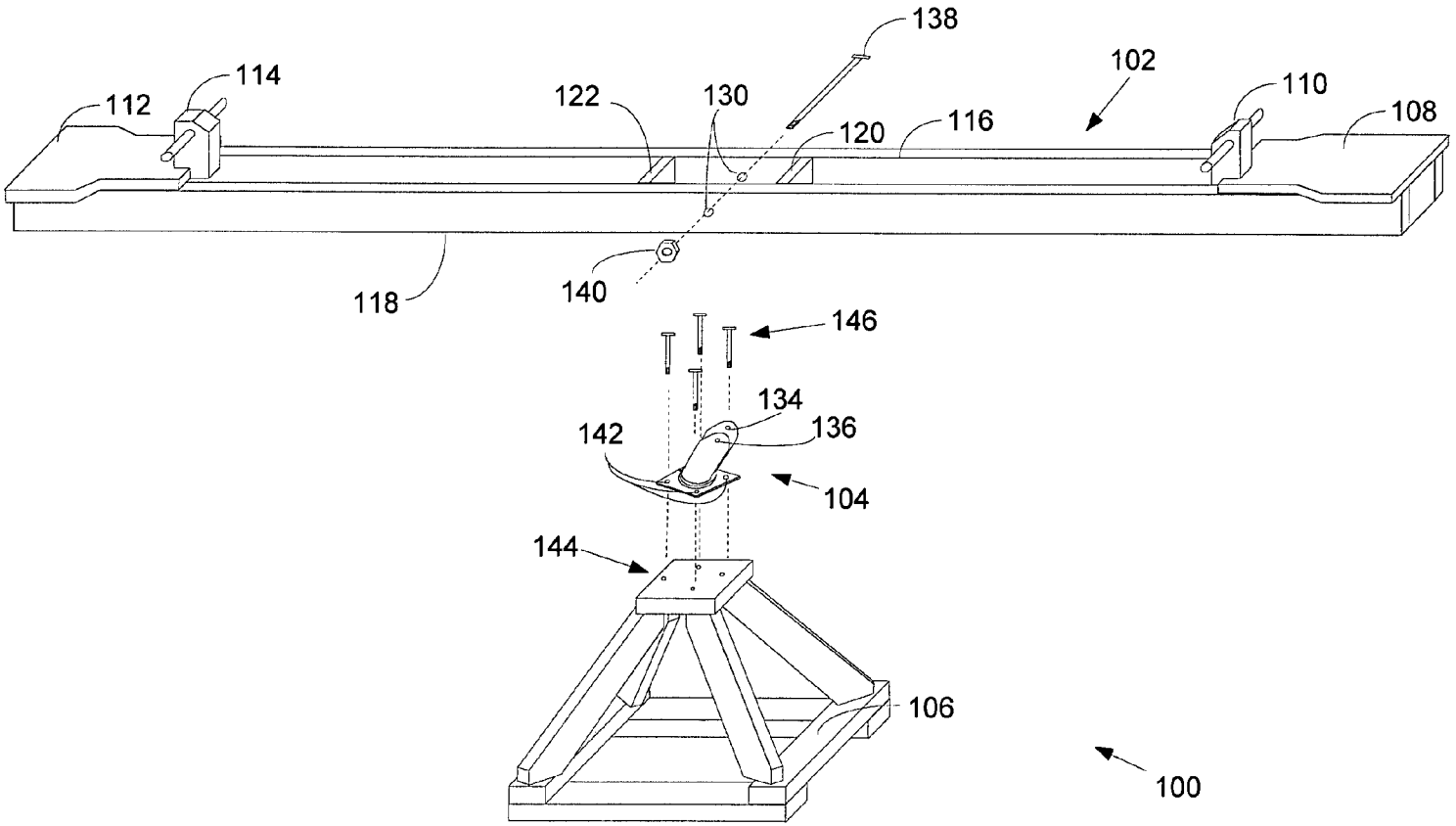
FIG. 2 illustrates a partial exploded perspective view of the teeter totter apparatus of FIG. 1, in accordance with an embodiment of the invention.

FIG. 2 illustrates a partial blow-out of a perspective view of the teeter totter apparatus of FIG. 1, in accordance with an embodiment of the invention. Components of FIG. 2 identified by reference numerals discussed with respect to FIG. 1 are the same, and will not be discussed in detail.

As shown, beam holes 130, 132 and caster yoke holes 134, 136 may be provided, such that alignment of the beam holes 130, 132 with the caster yoke holes 134, 136, allow a pivot pin, shown here as bolt 138, to be placed through the beam 102 and castor 104, allowing the beam to pivot/rotate about an axis of the pivot pin. The bolt 138 may be secured at the end by a pivot nut 140. Not shown, where the pivot pin is an unthreaded rod, it will be appreciated that the rod may include a hole through which a cotter pin may be placed to secure the rod. Other fastening devices may be utilized for the pivot pin. Although not shown, it will be appreciated by one skilled in the art that bushings, formed from brass, bronze, or some other metal, plastic or some other material, may be inserted into the beam holes 130,132 to reduce wear on the beam holes 130, 132 by the pivot pin. The bushings used may have substantially the same inner diameter as the outer diameter of the pivot pin. Further, although not shown, it will be appreciated by one skilled in the art that one or more washers may be utilized to reduce pressure between the bolt head and nut, and the beam, and to reduce friction between the caster and the beam.

The caster assembly 104 may include caster base holes, shown generally at 142, and the base 106 may include base portion holes shown generally at 144 that have a spacing substantially the same as the caster base holes 142. Fasteners shown generally at 146 may be inserted through caster base holes 142 and into base portion holes 144 allowing the caster assembly 104 to be secured to base portion 106. It will be appreciated that the fasteners 146 may be lag screws, bolts or any other fastener capable of sufficiently fastening the caster assembly 104 to the base portion 106. Where the fasteners 146 are bolts, it will be appreciated that nuts (not shown) may be provided to secure the caster 104 to the base portion 106.

A first axis of rotation may be defined about an axis that the caster assembly rotates, whereas a second axis of rotation may be defined about an axis of the pivot pin.

Figure 3:
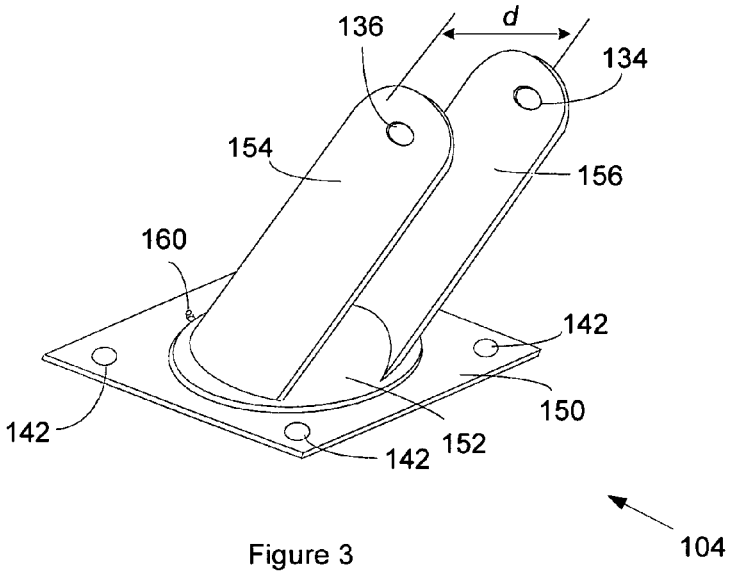
FIG. 3 illustrates a perspective view of an exemplary swivel caster assembly that may be utilized with a teeter totter apparatus, in accordance with an embodiment of the invention.

FIG. 3 illustrates a perspective view of an exemplary caster, in accordance with an embodiment of the invention. Components of FIG. 3 identified by reference numerals discussed with respect to FIGS. 1 and 2 are the same, and will not be discussed in detail.

It will be appreciated by one skilled in the art, that that the caster 104 may be a swivel caster assembly. Such assemblies are well known in the art, and may be, for example, a medium heavy-duty 6 inch×2 inch swivel caster, model number H1441B-6×2 produced by Faultless Caster of Nashville Tenn., with a 1500 LB weight rating. Such caster assembly need not include the wheel that may come disposed between the caster yoke arms. Such caster assemblies may include, for example, a king pin that is ½ inch to 1 inch in diameter, and may include a double ball bearing raceway, with an upper raceway utilizing 7⁄16 inch ball bearings and a lower raceway utilizing 5⁄16 inch ball bearings. The top plate may be formed from, for example, ⅛, ¼ or 5⁄16 inch thick plate, where the yoke arms may be formed from, for example, 3⁄32 inch or ¼ inch thick plate. Such swivel caster assembly may be, for example, approximately 6 inches tall, with a swivel radius of approximately 5.5 inches, and a base plate having an approximate dimensions, for example, 6.5 inches×6 inches.

As shown in FIG. 3, the caster 104 includes a caster base 150, and a caster bottom portion 152 that is rotationally coupled with the caster base 150, where a plane of the caster base 150 is substantially parallel with the plane of the caster bottom portion 152. The rotationally coupled relationship may be formed using, for example, a double ball bearing raceway (not shown) as described above, that may be disposed between the caster base 150 and the caster bottom portion 152. A first caster side 154 extends from the caster bottom portion 152, and includes a first caster hole, here the caster hole 136. The caster assembly 104 further includes a second caster side 156 that extends from the caster bottom portion 152, and includes a second caster hole, here the caster hole 134.

A distance d from the outer edge of the first caster side 154 to an outer edge of the second caster side 156 is less than a distance between the inside walls of the parallel runners 116 and 118 (FIGS. 1 and 2), thereby allowing the caster yoke to fit between the parallel runners of the beam 102. Thus, for example, the distance d may be approximately 3 inches, where a distance between the inside of the parallel runners may be 3.25 inches. The first and second caster holes 134 and 136 may be approximately ½ inches in diameter, where the bolt 138 (FIG. 2) may be a ½ inch diameter by 7 inch long hex bolt (i.e., zinc plated, stainless steel, or some other metal, and may be standard grade, or grade 8). The caster 104 may further include a standard grease fitting 160.

Figure 4:
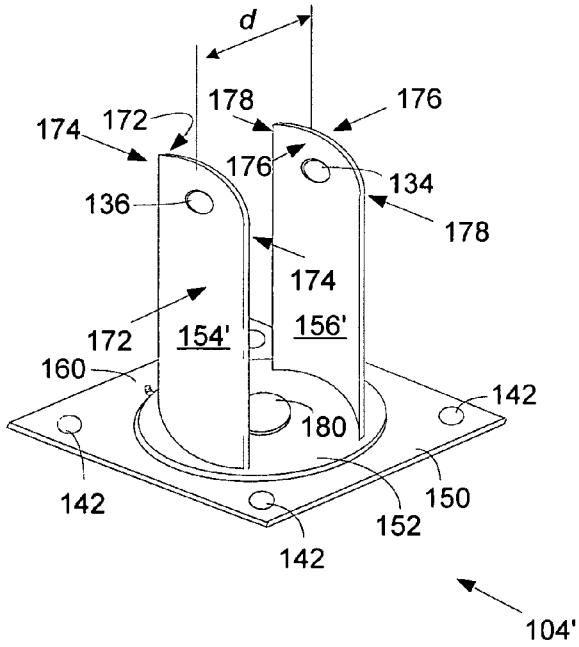
FIG. 4 illustrates a perspective view of another exemplary swivel caster assembly that may be utilized with a teeter totter apparatus, in accordance with an embodiment of the invention.

FIG. 4 illustrates a perspective view of a swivel caster assembly 104' that may be utilized with the teeter totter apparatus 100, in accordance with another embodiment of the invention. Components of FIG. 4 identified by reference numerals discussed with respect to FIG. 3 are the same, and will not be discussed in detail. The swivel caster 104' differs from the swivel caster 104 of FIG. 3, mainly in the configuration of the yoke arms, as is discussed below.

As shown in FIG. 4, the swivel caster 104' includes the caster base 150 that may be, for example, in an x-y plane. The caster bottom assembly 152 is substantially parallel to and rotationally coupled with the caster base 150, for example utilizing a double ball bearing race as discussed above. A first caster side 154' has a first pair of parallel first caster side edges shown at 172. The first caster side 154' further has a second pair of parallel first caster side edges shown at 174. The first pair of parallel first caster side edges 172 and second pair of parallel first caster side edges 174 both extend from the caster bottom assembly 152 along a z-axis. The first hole 136 extends through the first caster side 154' intersecting a plane of the first pair of parallel first caster side edges 172.

A second caster side 156' has a first pair of parallel second caster side edges 176. The second caster side 156' further has a second pair of parallel second caster edges shown at 178. The first pair of parallel second caster side edges 176 and second pair of parallel second caster side edges 178 both extend from the caster bottom assembly 152 along a z-axis. The second hole 134 extends through the second caster side 156' intersecting a plane of the first pair of parallel second caster side edges 176.

Similar to with the caster 104, the caster 104' may include a king pin 180 fixing the caster base 150 with the caster bottom assembly 152 while allowing the caster base 150 to be rotationally coupled with respect to the caster bottom assembly 152.

Similar to the caster 104, the distance d from the outer edge of the first caster side 154' to an outer edge of the second caster side 156' is less than a distance between the inside walls of the parallel runners 116 and 118 (FIGS. 1 and 2), thereby allowing the caster yoke to fit between the parallel runners of the beam 102. Thus, for example, the distance d may be approximately 3 inches, where a distance between the inside of the parallel runners may be 3.25 inches. The first and second caster holes 134 and 136 may be approximately ½ inches in diameter, where the bolt 138 (FIG. 2) may be a ½ inch diameter by 7 inch long hex bolt (i.e., zinc plated, stainless steel, or some other metal, and may be standard grade, or grade 8). The caster 104' may further include a standard grease fitting 160.

Other design parameters may be similar to that discussed above with respect to plate sizes used for the castor base and yoke arms, bearing sizes, bearing race sizes, and general dimensions.

Figure 5:
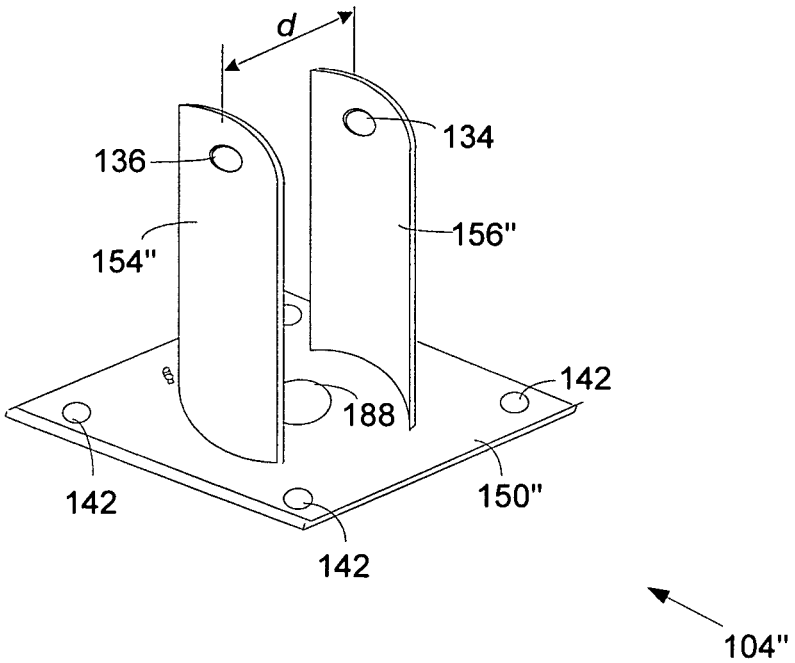
FIG. 5 is a perspective view of a rigid caster assembly that may be utilized with a teeter totter apparatus, in accordance with an embodiment of the invention.

FIG. 5 is a perspective view of a caster assembly 104" that may be utilized with a teeter totter apparatus in accordance with an embodiment of the invention. Components of FIG. 5 identified by reference numerals discussed with respect to FIG. 3 are the same, and will not be discussed in detail.

As shown in FIG. 5, the caster assembly 104" is a rigid caster, and includes a caster base 150". A first caster side 154" extends from a caster base 150", and includes a first caster hole, here the caster hole 136. The caster assembly 104" further includes a second caster side 156" that extends from the caster base 150", and includes a second caster hole, here the caster hole 134.

The first and second caster sides 154" and 156" are fixed to the caster base 150" and thus do not rotate or otherwise move with respect to the caster base 150". The caster 104" further includes a caster base hole, that may be aligned with a hole in the base portion and through which a bolt may be placed to secure the caster 104" with the base portion, as is discussed further below.

A distance d from the outer edge of the first caster side 154" to an outer edge of the second caster side 156" is less than a distance between the inside walls of the parallel runners 116 and 118 (FIGS. 1 and 2), thereby allowing the caster yoke to fit between the parallel runners of the beam 102. Thus, for example, the distance d may be approximately 3 inches, where a distance between the inside of the parallel runners may be 3.25 inches. The first and second caster holes 134 and 136 may be approximately ½ inches in diameter, where the bolt 138 (FIG. 2) may be a ½ inch diameter by 7 inch long hex bolt (i.e., zinc plated, stainless steel, or some other metal, and may be standard grade, or grade 8). The caster 104" may further include the standard grease fitting 160. The caster 104" is shown with slightly curved first and second caster sides 154" and 156" respectively. It will be apparent to one skilled in the art that the first and second caster sides 154" and 156" may instead be straight.

Figure 6:
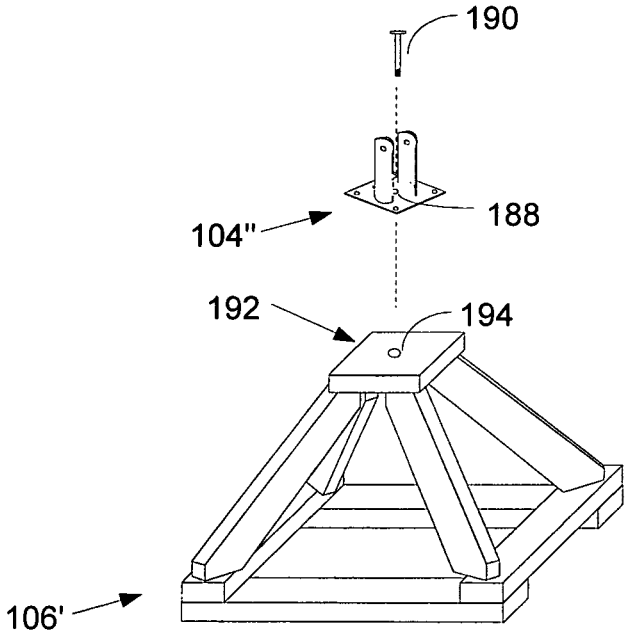
FIG. 6 is a partial exploded perspective view illustrating coupling between a rigid caster assembly and a base, in accordance with an embodiment of the invention.

FIG. 6 is a partial exploded perspective view illustrating the coupling between the rigid caster 104" and a base 106'. The base 106' may differ from the base 106 discussed above, by for example, the hole pattern at the top portion of the base 106'.

As shown in FIG. 6, a base portion hole 194 is provided, for example at a center of a top portion 192 of the base 106. The rigid caster 104" may rest on the top portion 192, where the caster hole 188 is aligned with the base portion hole 194, and a bolt 190 is placed through to secure the caster 104" to the base 106'. Although not shown, a nut is provided to hold the bolt 190 secure. The nut is tightened only tight enough to allow the caster 104" to rotate about the axis of the bolt. It will be appreciated that a second nut or securing means may be provided, and tightened against the first nut, to lock the nut into place. Although not shown, a bushing (i.e., metallic such as bronze or brass, or plastic) may be placed in the base portion hole 194, the inner diameter of the bushing of approximately the same diameter as the bolt 190. Such bushing may, for example, prevent premature wear of the base portion hole 194. Further, although not shown, one or more washers may be utilized in securing the caster 104" to the base 106'. For example, a fender washer may be utilized between the caster 104" and the top portion 192 of the base portion 106', providing a bearing to reduce friction between the caster 104" and the base portion 106'. In the alternative, the top portion 192 may be coated with a reduced friction material such as a metallic or plastic material, to help reduce friction between the caster 104" and the top portion 192 of the base 106'. Similarly, a metallic or plastic plate may be utilized between the caster 104" and the base 106', where the plate includes a hole of at least the diameter of the bolt 190.

The bolt may be for example a ½ inch by 4 inch bolt, where the caster hole 188 and base portion hole 194 are sufficiently sized to receive the bolt 190. The bolt may be coated, for example zinc coated, or may be stainless steel. Where a bushing is utilized in the base portion hole 194, the base hole 194 is sufficiently sized to receive the bushing.

Figure 7:
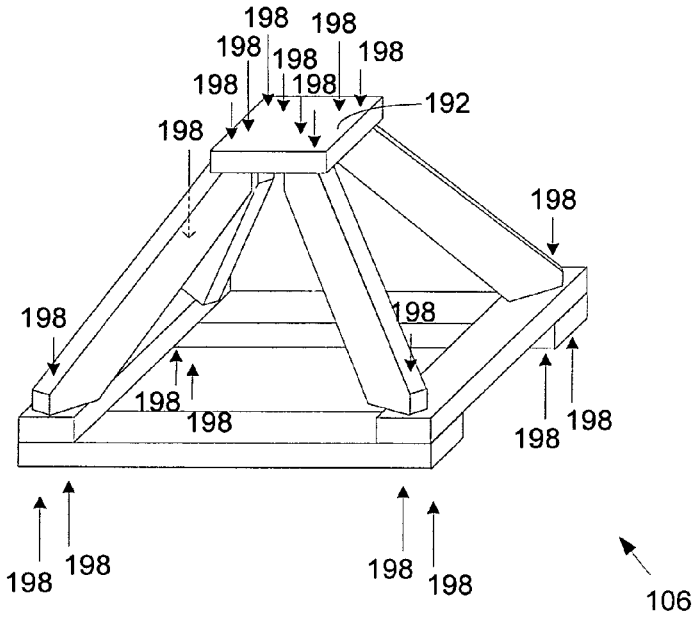
FIG. 7 is a more detailed perspective view of a base that may be used with the teeter totter apparatus, in accordance with an embodiment of the invention.

FIG. 7 is a more detailed perspective view of the base 106 that may be used with the teeter totter apparatus, in accordance with an embodiment of the invention. As shown in FIG. 7, the various portions of the base 106 may be held together at various locations 198 with screws (not shown). The screws may be, for example, 2¾ inch #8 screws, that may be steel, stainless steel, or coated steel. Other screw sizes and lengths may be utilized. Further, the screw locations are exemplary, and other screw patterns may be utilized, as will be appreciated by one skilled in the art. The base may have one or more hole patterns (for example, as shown in FIGS. 2 and 6) on the top portion 192, where the particular hole pattern utilized is dependent on the hole pattern of the particular caster being coupled with the base. As discussed above, the base may be comprised of lumber, metal or other substance sufficient for meeting weight and stress requirements of the teeter totter apparatus 100. Further, the base 106 design is merely exemplary, where other design and shape configurations may be utilized while still achieving at least some advantages of the invention.

Figure 8:
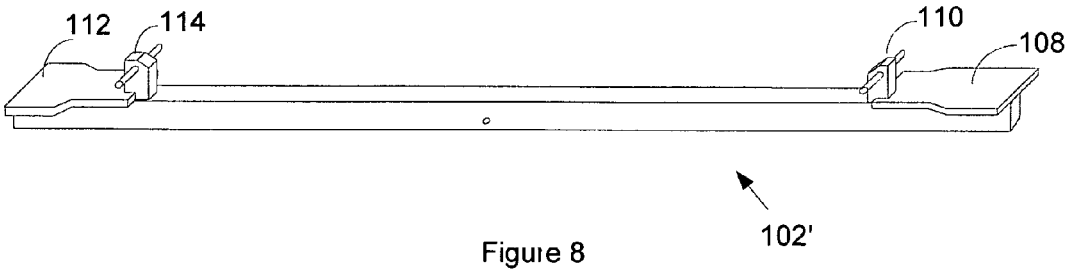
FIG. 8 illustrates a perspective view of a beam that may be utilize with a teeter totter apparatus, in accordance with an embodiment of the invention.

FIG. 8 illustrates a perspective view of a beam 102' that may be utilize with the teeter totter apparatus 100 in accordance with an embodiment of the invention. As shown in FIG. 8, the beam 102' may be a one-piece beam, for example constructed from 4×4 inch or 4×6 inch lumber. The seats 108 and 112 may be constructed from, for example, 2×10 lumber and cut a sufficient length to allow comfortable seating for a rider. The handles 110 and 114 may be cut from, for example, 4×4 lumber, where a 1 inch hole (not shown) may be drilled and a doll rod having a diameter of less than 1 inch is placed through the hole to create a grip for the handles 110 and 114. The doll rod may be, for example, ⅞ inch diameter and 10 inches in length. Not shown, screws such as 1 inch #6 or 1 inch #8 screws may be utilized to secure the doll rod grip into the handles 110 and 114. The seat 108 and 112, and handle 110 and 114 configurations are merely exemplary, and other configurations, shapes and sized may be utilized, as will be appreciated by one skilled in the art.

In accordance with another aspect of the invention, an adjustable seat is provided that may be utilized with a teeter totter apparatus.

Figure 9:
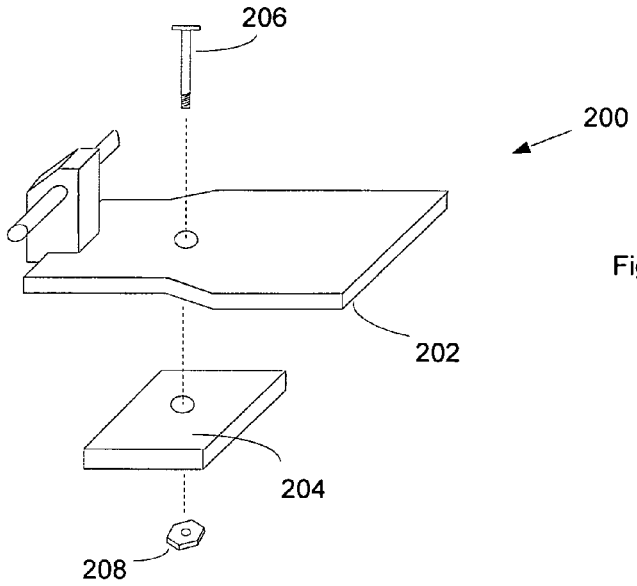
FIGS. 9-11 are partially exploded perspective views of various adjustable seat configurations that may be utilized with a teeter totter apparatus, in accordance with various embodiments of the invention.

FIG. 9 is a partially exploded perspective view of an adjustable seat 200 that may be utilized with a teeter totter apparatus, in accordance with an embodiment of the invention. As shown in FIG. 9, the adjustable seat 200 may include opposing seat portions, used to sandwich the beam for a frictional hold. A first opposing seat portion is shown as a top seat portion 202, and the other opposing seat portion is shown as a bottom seat portion 104. A contracting mechanism is shown as a seat bolt 206 and nut 208. The nut 208 is shown as a standard hex nut, but may instead be a wing nut, or a nut recessed within a plastic handle (such as a molded plastic handle that is round, star-shaped, etc. . . . ), as will be appreciated by one skilled in the art. In the alternative and not shown, the contracting mechanism may be a quick release mechanism where a threaded rod extends from the top to a curved-lever bottom, such that tightening of the lever bottom pulls the top seat portion 202 and bottom seat portion 204 closer together to cause a friction hold against the beam.

Figure 10:
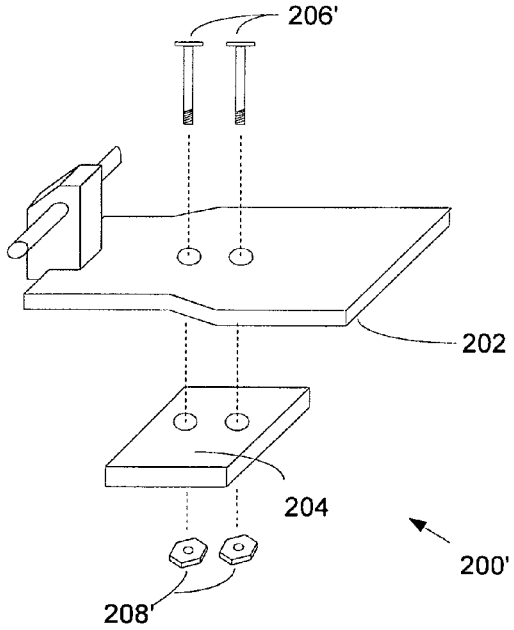

FIG. 10 is a partial exploded perspective view of an adjustable seat 200', that may be utilized a the teeter totter apparatus in accordance with an embodiment of the invention. Components of FIG. 10 identified by reference numerals discussed with respect to FIG. 9 are the same, and will not be discussed in detail.

The seat 200' of FIG. 10 differs from the seat 200 in FIG. 9, mainly by the configuration of the contracting mechanism. As shown in FIG. 10, the contracting mechanism may comprise two bolts, shown here as bolts 206' and two nuts, shown here as nuts 208'.

Figure 11:
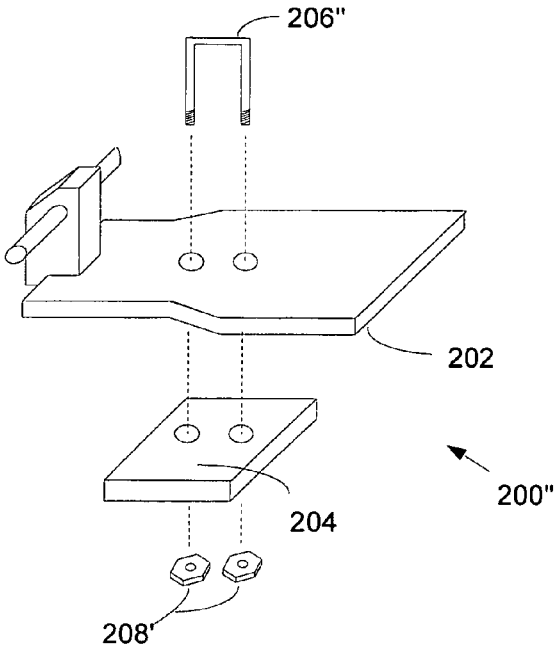

FIG. 11 is a partial exploded perspective view of an adjustable seat 200", that may be utilized with a teeter totter apparatus in accordance with an embodiment of the invention. Components of FIG. 11 identified by reference numerals discussed with respect to FIG. 9 are the same, and will not be discussed in detail.

The seat 200" of FIG. 11 differs from the seat 200 in FIG. 9, mainly by the configuration of the contracting mechanism. As shown in FIG. 11, the contracting mechanism may comprise a u-bolt, shown here as bolt 206".

It will be apparent that the bolts 206' or u-bolt 206" may serve to maintain the respective seating portion 200' and 200" in a substantially aligned state while it is being adjusted along the beam. Additional bolts, or a wider spacing between arms of the u-bolt 206", may be utilized to provide further alignment accuracy of the seating portions 200' and 200" during adjustment along the beam.

Figure 12:
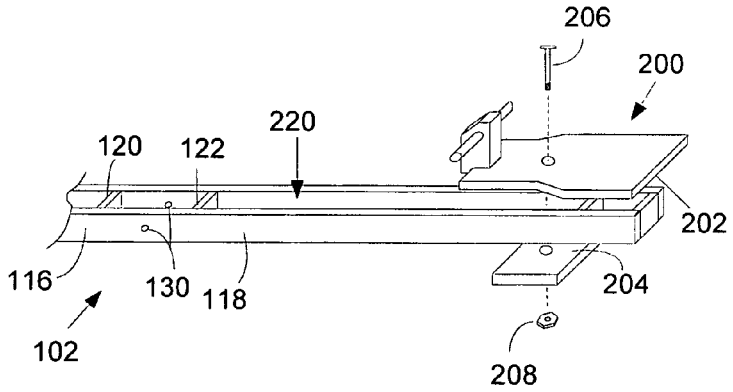
FIGS. 12-15 are partial exploded perspective views illustrating use of various adjustable seat configurations with a teeter totter beam, in accordance with various embodiments of the invention.

FIG. 12 is a partial exploded perspective view illustrating use of an adjustable seat with a teeter totter beam in accordance with an embodiment of the invention. Components of FIG. 11 identified by reference numerals previously discussed with respect to FIGS. 1, 2 and 9 are the same, and will not be discussed in detail.

As shown in FIG. 12, the parallel runners 116 and 118 include the first cross member 120 disposed between the parallel runners 116,118 at one side of the beam, here the beam 102, and a second cross member 122 disposed between the parallel runners 116,118 at the other side of the beam. Here, the cross members being at one side or the other side of the beam includes the cross members being located at any point on their respective side of the beam past the substantially central beam holes 130. Further cross members are shown in FIG. 12. The parallel runners 116, 118 form a channel 220 for the beam 102.

The contracting mechanism, here the bolt 206, extends through the upper seat portion 202, through the channel 220, and through the bottom seat portion 204, and is secured by nut 208. The tightening of the nut (and thus placing the contracting mechanism in a taught state) draws the upper seat portion 202 and the lower seat portion 204 to the parallel runners 116, 118 of the beam, thereby frictionally fixing the seat in place along the beam 102. The loosening of the nut (and thus placing the contracting mechanism in a loose state) releases the upper seat portion 202 and the lower seat portion 204 friction fit from the parallel runners 116, 118 of the beam, thereby allowing the seat to be adjusted at a different location along the beam 102.

Figure 12A:
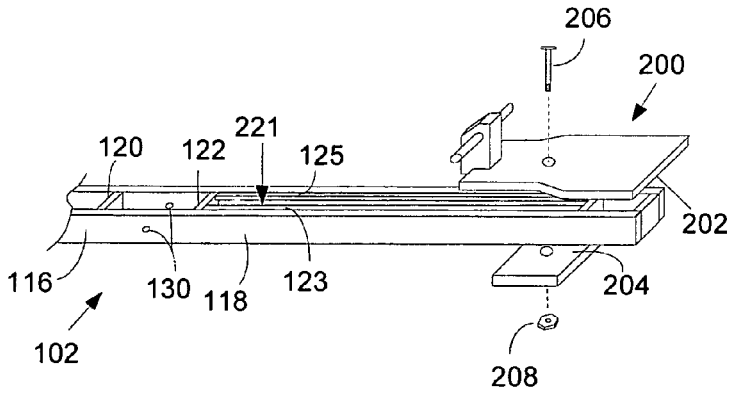

FIG. 12A is a partial exploded perspective view illustrating use of an adjustable seat with a teeter totter beam in accordance with an embodiment of the invention. Components of FIG. 12A identified by reference numerals previously discussed with respect to FIG. 12 are the same, and will not be discussed in detail. As shown in FIG. 12A, the beam, here the beam 102, further includes beam inserts 123, 125 at the inside edges of the parallel runners 116,118. The beam inserts 123, 125 reduce the size of the opening between the parallel runners 116, 118, thereby reducing the chance that a body part of a rider may be caught between the parallel runners. A space between the beam inserts 123, 125 form a channel 221, thru which the bolt 206 may extend in a similar fashion as discussed above with respect to FIG. 12. The beam inserts may be comprised of, for example, one-by lumber, such as ripped from a piece of 1×4 lumber, and may each have exemplary dimensions of ¾ inch×1 inch by 35 inches. Other dimensions may be used.

Figure 13:
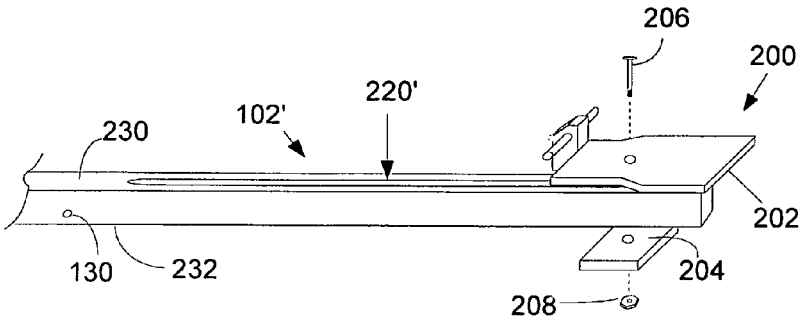

FIG. 13 is a partial exploded perspective view illustrating use of an adjustable seat with a teeter totter beam in accordance with an embodiment of the invention. Components of FIG. 13 identified by reference numerals previously discussed with respect to FIGS. 1, 2, 8 and 9 are the same, and will not be discussed in detail.

As shown in FIG. 13, the beam, here the beam 102', may be a single piece beam, having a top side 230 and a bottom side 232, with a channel 220' extending along the beam from the top side 230 to the bottom side 232.

The contracting mechanism, here the bolt 206, extends through the upper seat portion 202, through the channel 220', and through the bottom seat portion 204, and is secured by nut 208. The tightening of the nut (and thus placing the contracting mechanism in a taught state) draws the upper seat portion 202 and the lower seat portion 204 to the beam 102', thereby frictionally fixing the seat in place along the beam 102'. The loosening of the nut (and thus placing the contracting mechanism in a loose state) releases the upper seat portion 202 and the lower seat portion 204 friction fit from the beam 102', thereby allowing the seat 200 to be adjusted at a different location along the beam 102'.

Figure 14:
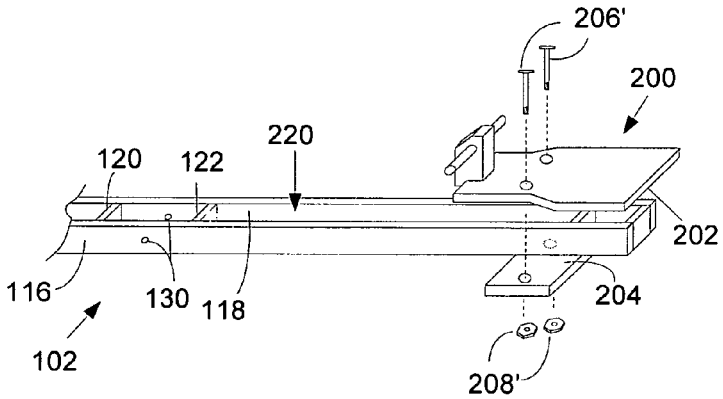

FIG. 14 is a partial exploded perspective view illustrating use of an adjustable seat with a teeter totter beam in accordance with an embodiment of the invention. Components of FIG. 14 identified by reference numerals previously discussed with respect to FIGS. 1, 2, 9 and 11 are the same, and will not be discussed in detail.

As shown in FIG. 14, the contracting mechanism comprises two bolts 106, oriented in a fashion such that they need not extent through a channel in the beam, here the beam 102, but rather, may extend on either side of the beam 102.

The tightening of the nuts 208' (and thus placing the contracting mechanism in a taught state) draws the upper seat portion 202 and the lower seat portion 204 to the parallel runners 116, 118 of the beam, thereby frictionally fixing the seat in place along the beam 102. The loosening of the nuts 208' (and thus placing the contracting mechanism in a loose state) releases the upper seat portion 202 and the lower seat portion 204 friction fit from the parallel runners 116, 118 of the beam, thereby allowing the seat to be adjusted at a different location along the beam 102.

Figure 15:
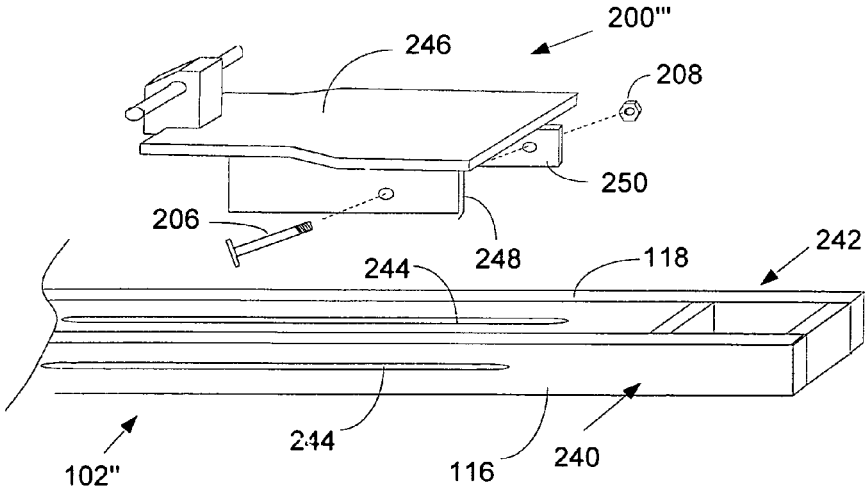

FIG. 15 is a partial exploded perspective view illustrating use of an adjustable seat with a teeter totter beam in accordance with an embodiment of the invention. Components of FIG. 15 identified by reference numerals previously discussed with respect to FIGS. 1, 2, and 9 are the same, and will not be discussed in detail.

As shown in FIG. 15, a beam, here the beam 102", comprises parallel runners 116 and 118. Here, the beam 102" includes a first beam side 240 and a second beam side 242, where a channel 244 extends through the parallel runners 116,118 from the first beam side 240 through the second beam side 242.

A seat 200" includes a seat top portion 246, and opposing seat portions, including a first side seat portion 248 coupled with and extending down from the seat top portion 246, and a second side seat portion 250 that is opposite the first side seat portion and disposed below the top seat portion 246. As shown the second side seat portion is not coupled with the seat top portion 246, however, one skilled in the art will realize that it could be. The contracting mechanism, here the bolt 206, extends through the first side seat portion 248, through the channel 244, through the second side seat portion 250, and is secured by nut 208. The tightening of the nut (and thus placing the contracting mechanism in a taught state) draws the first side seat portion 248 and the second side seat portion 250 to the parallel runners 116, 118 of the beam, thereby frictionally fixing the seat in place along the beam 102". The loosening of the nut (and thus placing the contracting mechanism in a loose state) releases the first side seat portion 248 and the second side seat portion 250 friction fit from the parallel runners 116, 118 of the beam 102", thereby allowing the seat to be adjusted at a different location along the beam 102".

Although not shown, the seat 200" may similarly be utilized with the beam 102' that includes a channel running parallel with the beam top, as will be appreciated by one skilled in the art.

The bolts 206, 206' or the U-bolt may have, for example a ⅜ inch diameter and be approximately 7 inches long when used with the beam 102 or 102', and may be approximately 8 inches long when used with the beam 102". The spacing between U-bolt arms may be, for example, 2.5 inches. Other dimensions may be used.

It will be apparent, that although the adjustable seats 200, 200' and 200" have been discussed as being utilized on a beam for a teeter totter apparatus such as teeter totter apparatus 100, such seats may be utilized on a beam for a traditional teeter totter apparatus having a single pivot/fulcrum that is capable of rotating only about a single axis parallel to the ground.

In accordance with another aspect of the invention, a friction reduction portion may be utilized to help reduce friction between the beam and the ground in the event that the teeter totter beam contacts the ground while the beam is rotating about an axis perpendicular to the ground.

Figure 16:
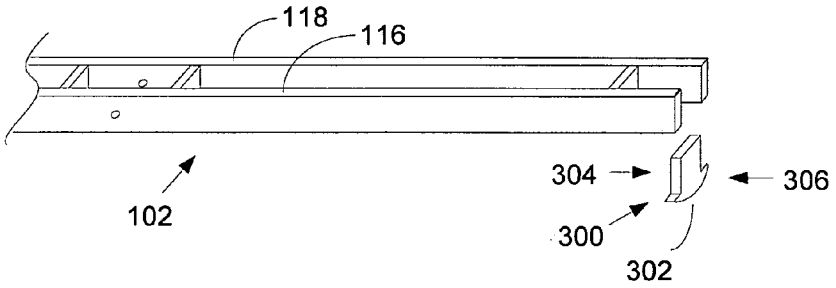
FIGS. 16-19 illustrate views of various friction reduction portions, and their use with a beam of a teeter totter apparatus, in accordance with various embodiments of the invention.

FIG. 16 is a partially-exploded perspective view of a beam and friction reduction portion in accordance with an embodiment of the invention. Components of FIG. 16 identified by reference numerals previously discussed with respect to FIG. 1, or 2 are the same, and will not be discussed in detail.

As shown in FIG. 16, a friction reduction portion 300 includes a curved bottom portion 302, and includes a side 304 that faces the beam 102 and a side 306 that faces away from the beam. Not shown, the friction reduction portion 300 is coupled (for example, using fasteners such as screws) to the beam 102 at one or both ends of the beam, between the parallel runners 116, 118. While the beam is rotating about an axis parallel to the ground, the curved portion 302 reduces friction between the ground and the friction reduction portion 300 where the beam end makes contact with the ground.

Where a beam such as beam 102' is utilized, the friction reduction portion may be fixed to the end of the beam 102' to achieve at least some of the advantages of the invention.

Figure 17:
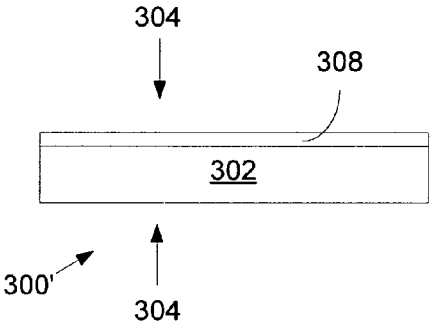
Figure 18:
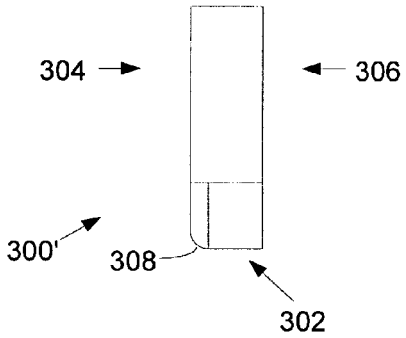

FIGS. 17 and 18 are bottom and side views of a friction reduction portion 300', respectively, in accordance with an embodiment of the invention. Components of FIGS. 17 and 18 identified by reference numerals previously discussed with respect to FIG. 16, are the same, and will not be discussed in detail. As shown in FIGS. 17 and 18, an friction reduction portion 300' may include a rounded edge 308 along the curved edge 302, further serving to reduce friction between the teeter totter beam and the ground in the event the beam contacts the ground while the beam is rotating about an axis perpendicular to the ground. The rounded edge 308 may be formed, for example, using a router with a router bit having a sufficient profile to form the curved edge 308 of the friction reduction portion 300'.

Figure 19:
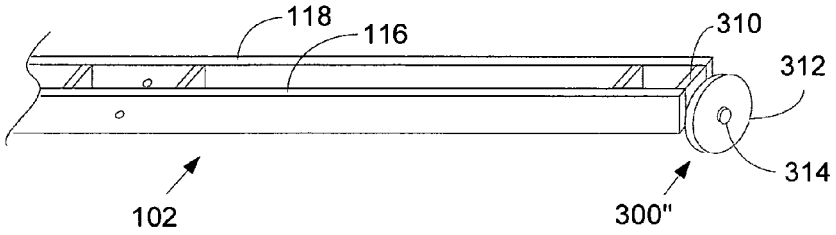

FIG. 19 is a perspective view of a beam and friction reduction portion 300" in accordance with an embodiment of the invention. Components of FIG. 19 identified by reference numerals previously discussed with respect to FIG. 1 or 2 are the same, and will not be discussed in detail.

As shown in FIG. 19, a friction reduction portion 300" includes a wheel 312 coupled to an end cross member 310 of a beam, here the beam 102, via an axle bolt 314. Such friction reduction portion 300" may be utilized at one or both ends of the beam 102. Where the beam contacts the ground while it is rotating about an axis parallel to the ground, the wheel 312 may spin, thereby reducing friction between the ground and the friction reduction portion 300". It will be apparent to one skilled in the art that the friction reduction portion 300" may additionally be employed in conjunction with the single piece beam 102', discussed above.

In accordance with another aspect of the invention, more than one seating portion may be placed on one side of a teeter totter apparatus.

Figure 20:
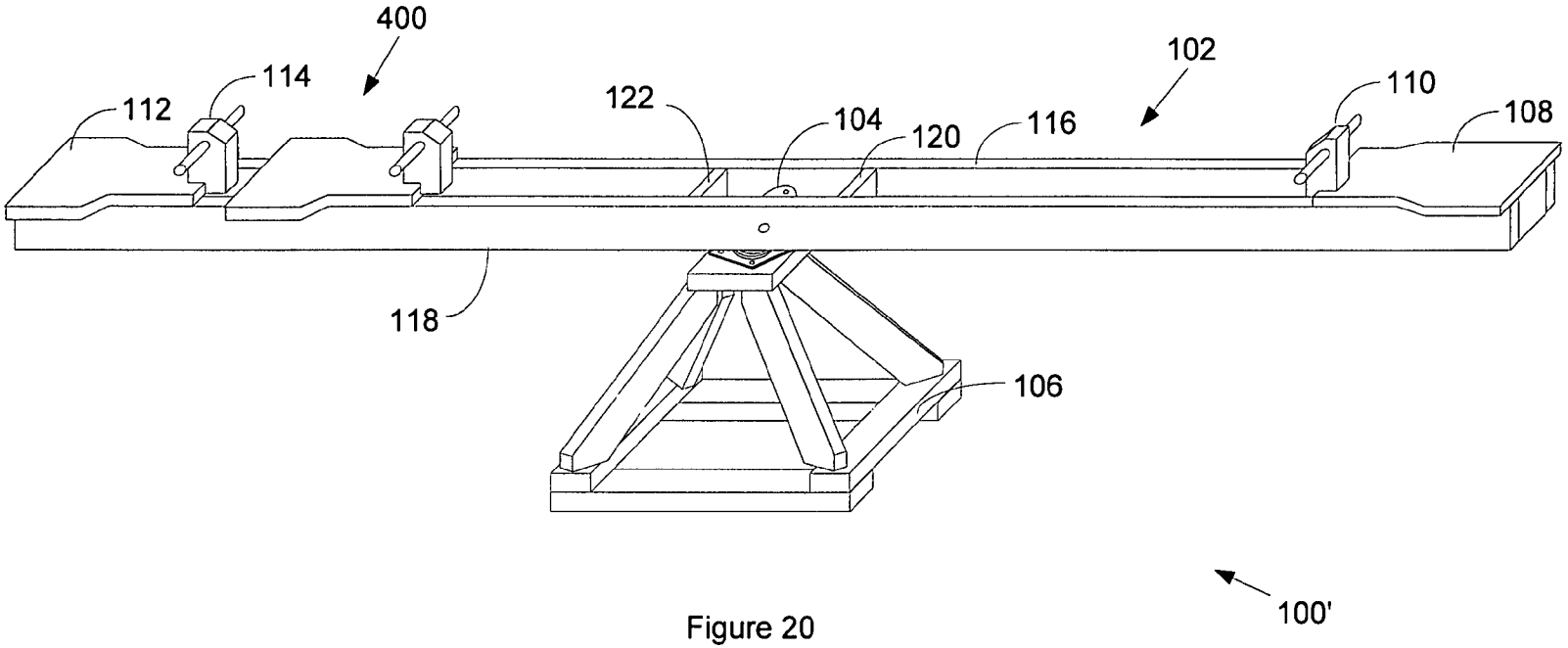
FIG. 20 is a perspective view of a teeter totter apparatus having multiple seats on at least one side of the beam, in accordance with an embodiment of the invention.

FIG. 20 is a perspective view of a teeter totter apparatus 100' with multiple seats on one side of the beam, in accordance with an embodiment of the invention. Components of FIG. 20 identified by reference numerals previously discussed with respect to FIG. 1 or 2 are the same, and will not be discussed in detail. As shown in FIG. 20, the teeter totter apparatus 100' includes a second seat portion 400 on one side of the beam 102 of the teeter totter. Although the seats 108, 112 and 400 are shown to be fixed seats, one skilled will realize that one or more of the seats may be adjustable along the length of the beam, for example, as discussed above with respect to FIGS. 9-15. Further, although the teeter totter apparatus 100' is illustrated with capabilities of rotating about a first axis while rotating about a second axis different than the first axis, it will be appreciated that utilization of multiple seats on at least one end of a teeter totter beam may be accomplished on a traditional teeter totter that only rotates about a single axis formed by the pivot/fulcrum.

Figure 21:
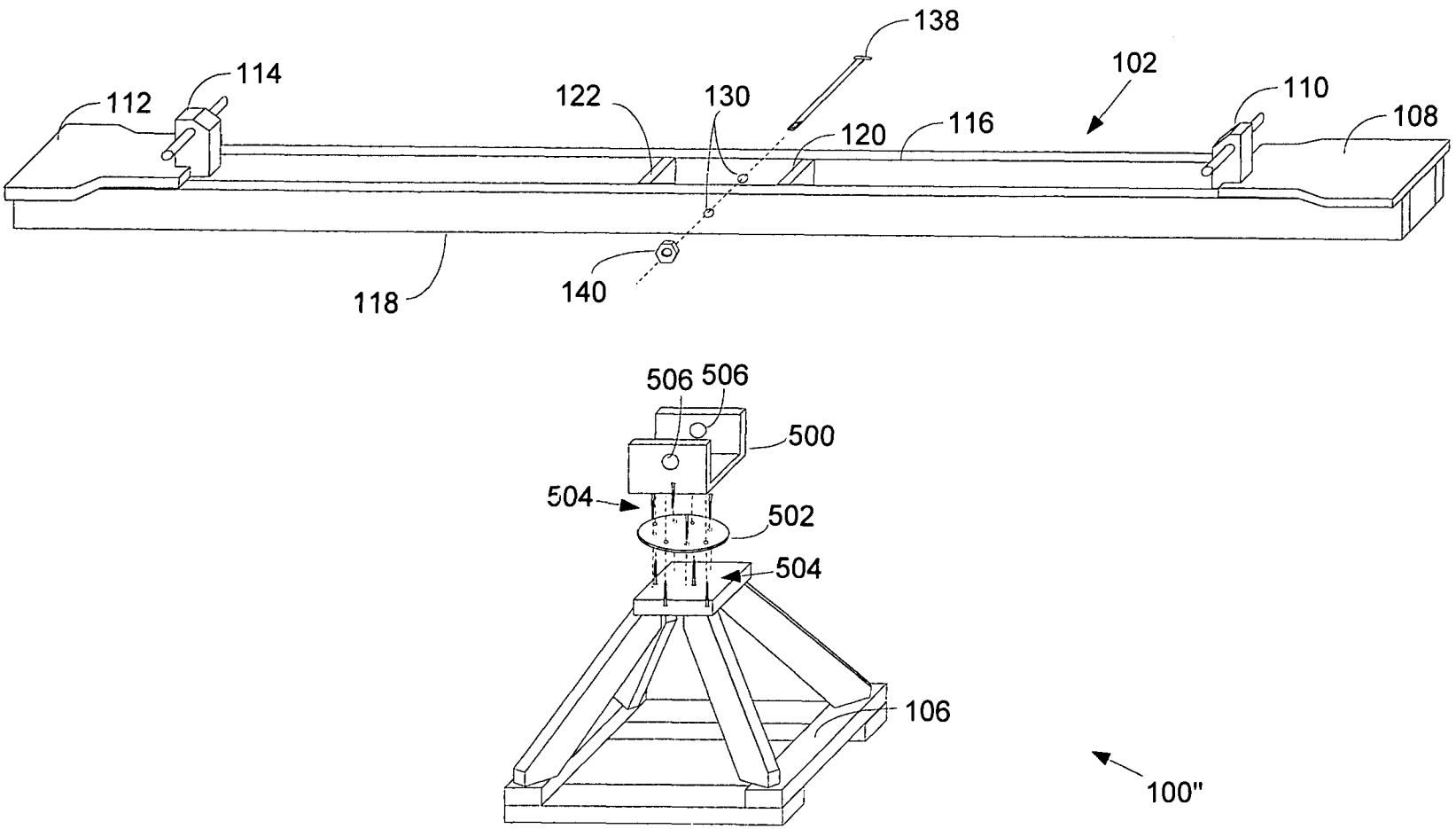
FIG. 21 is a partial exploded perspective view of a teeter totter apparatus, in accordance with an embodiment of the invention.

FIG. 21 is a partial exploded perspective view of a teeter totter apparatus 100" in accordance with another embodiment of the invention. Components of FIG. 21 identified by reference numerals previously discussed with respect to FIG. 1 or 2 are the same, and will not be discussed in detail.

As shown in FIG. 21, a yoke assembly 500 is couple to the base 106 via a lazy susan bearing 502 using screws 504. The yoke assembly 500 is sized such that the parallel runners 116, 118 of the beam 102 fit within the yoke assembly 500, allowing the beam holes 130 to align with yoke holes 506. A bolt for example bolt 138 may then be placed through the beam holes 130 and yoke holes 506, fixing the beam 102 to the yoke assembly 500. The beam may rotate about the pivot pin formed by the bolt 138.

The lazy susan bearing 502 allows the yolk assembly 500 (and thus the beam 102) to revolve about an axis through the approximate center of the lazy susan bearing 502. Lazy susan bearings are well known, and will not be discussed in detail. The lazy susan bearing 504 is designed sufficiently to withstand the shear forces (side-to-side forces) on the beam exerted by the riders, and is of sufficient design to withstand compression forces caused by the weight of the riders. Although not shown, one or more of the seats may be adjustable seats 200, 200' or 200", discussed above. The yoke may be formed from, for example, metal, or wood (i.e., cut from 2×6 or 2×8 dimension). Instead of the bolt 138, any rod or axel including pipe, may be utilized to form the pivot, with the beam holes 130 and yoke holes 506 being sufficiently sized to receive the rod/axel. Bushings may be used in one or more of the beam holes 130 and yoke holes 506.

Although the yoke assembly is shown as a u-shaped yoke assembly 500, it will be apparent to one skilled in the art that the yoke assembly may instead be comprised of a single-piece solid block, through which a hole is bored to form a single yoke hole 506. In this case, the yoke and spacing between the parallel runners of the beam would be such that the yoke assembly may fit between the parallel runners, and the yoke hole 506 aligned with the beam holes 130, through which the pivot pin 138 may be placed to secure the beam to the yoke.

In accordance with an embodiment of the invention, the beam 102, 102' 102" may have a length of ten feet. The beam 102 and 102" may have a width between parallel runners 116 and 118 of 3.25 inches. The beam 102, 102' and 102" may be other lengths as well, for example 8 feet or 12 feet. Other beam lengths may be utilized, where the base, portion is sized and configured/shaped to allow the beam to rotate about the first axis without interference with the base portion.

The beam 102, base 106, seats 108 and 112, 200, 200' and 200", and handle portions 110 and 114 may be constructed of lumber, for example, pine, oak, cedar, or redwood, or treated lumber such as treated southern pine lumber. The treated lumber may be, for example, ACQ, ACQ2, Copper Sulfate, or any other treatment that assists in resistance to weather and/or bugs. The lumber or treated lumber may be dipped in plastic or some other coating to aid in resilience to weather and bugs. The lumber or treated lumber may comprise any combination of one-by, two-by, or 4-by lumber, including 1×4, 1×6, 1×8, 1×10, 1×12, 2×4, 2×6, 2×8, 2×10, 2×12, 4×4, and 4×6 lumber. Other dimensions may be utilized, ensuring that the dimensions provide sufficient strength for use with the teeter totter apparatus.

Further, although not shown, it will be apparent that a cover assembly may be provided to cover a portion of the beam over the caster assembly to keep body parts out of the caster assembly, and to help protect the caster assembly from environmental conditions such as weather.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A teeter totter apparatus, comprising:

a base portion;

a caster assembly coupled with the base portion, including a caster base portion, and a caster yoke portion rotationally coupled with the caster base portion about a king pin, allowing rotation of the caster yoke portion about a first axis, the caster yoke including a first and second substantially parallel yoke side portions including respective first and second caster yoke pivot pin holes;

a beam portion, including at least one seating portion and at least one beam hole, the at least one beam hole capable of being aligned with the first and second caster holes through which a pivot pin is placed, fixing the beam portion to the caster yoke portion while allowing the beam portion to rotate about a second axis, and including a friction reduction portion integrated at an underside of at least one end of the beam portion, the friction reduction portion comprising a curved surface, thereby reducing the friction between the beam portion and a surface on which the base portion rests when the beam portion contacts the surface while it is rotating about the first axis.

2. The teeter totter apparatus of claim 1, wherein the caster assembly is a swivel caster assembly, and the caster yoke portion rotationally coupled with the caster base portion via a king pin includes a ball bearing race and ball bearings being disposed between an upper surface of the caster base portion and a lower surface of the caster yoke portion.

3. The teeter totter apparatus of claim 1, wherein the beam portion includes a continuous channel, and further including an opposing seat adjustment portion, and a contracting mechanism, where the contracting mechanism couples the seat portion with the opposing seat adjustment portion and is disposed through the continuous channel and sandwiches the beam portion between the seat portion and the opposing seat adjustment portion, such that when the contracting mechanism is in a loose state, friction is reduced between the seat portion, the opposing seat adjustment portion and the beam portion, thereby allowing the seating portion to be moveable along the continuous channel of the beam portion, and when the contracting mechanism is in a taught state, the seat portion and the opposing seat adjustment portion are frictionally secured against the beam portion to prevent the seat portion from movement along the continuous channel of the beam portion.

4. The teeter totter apparatus of claim 3, wherein the beam portion includes a first parallel runner and a second parallel runner, with the continuous channel being formed by a space between the parallel runners, and where the seat portion is disposed on a top beam side of the first and second parallel runners, and the opposing seat adjustment portion is disposed on a bottom beam side of the first and second parallel runners, the contracting mechanism extending at least in part through the continuous channel and coupling together the seat portion and opposing seat adjustment portion to allow the first and second parallel runners to be sandwiched between the seat portion and opposing seat adjustment portion, such that when the contracting mechanism is in a loose state, friction is reduced between the seat portion, the opposing seat adjustment portion and the parallel runners, thereby allowing the seating portion to be moveable along the continuous channel of the beam, and when the contracting mechanism is in a taught state, the seat portion and opposing seat adjustment portion are frictionally secured against the parallel runners to prevent the seat portion from movement along the continuous channel of the beam.

5. The teeter totter apparatus of claim 3, wherein the contracting mechanism comprises at least one threaded bolt and a nut, such that the bolt is disposed through a hole in the seat portion, through the continuous channel, and through a hole in the opposing seat adjustment portion, where the nut is threaded to the bolt, causing the beam to be sandwiched between the seat portion and the opposing seat adjustment portion, and where loosening the nut reduces friction between the seat portion, the opposing seat adjustment portion and the beam, to allow the seating portion to move along the continuous channel of the beam, and tightening the nut increases friction between the seat portion and opposing seat adjustment portion and the beam, preventing the seat portion from moving along the continuous channel of the beam.

6. The teeter totter apparatus of claim 1, further including an opposing seat adjustment portion, and a contracting mechanism, where the contracting mechanism couples the seat portion with the opposing seat portion and sandwiches the beam portion between the seat portion and the opposing seat adjustment portion, such that when the contracting mechanism is in a loose state, friction is reduced between the seat portion, the opposing seat adjustment portion and the beam portion, thereby allowing the seating portion to be moveable along the beam portion, and when the contracting mechanism is in a taught state, the seat portion and the opposing seat adjustment portion are frictionally secured against the beam portion to prevent the seat portion from movement along the beam portion.

7. The teeter totter apparatus of claim 1, wherein the beam portion including at least one seating portion includes the beam portion including at least two seating portions disposed on a same side of the beam portion.

8. A teeter totter apparatus, comprising:

a base portion;

a beam portion coupled with the base portion;

at least one seating portion;

an opposing seat adjustment portion; and a contracting mechanism that couples the seat portion with the opposing seat adjustment portion, thereby sandwiching the beam between the seat portion and the opposing seat adjustment portion, such that when the contracting mechanism is in a loose state, friction is reduced between the seat portion, the opposing seat adjustment portion and the beam portion to allow the seating portion to be moveable along the beam, and when the contracting mechanism is in a taught state, the seat portion and the opposing seat adjustment portion are frictionally secured against the beam to prevent the seat portion from movement along the beam.

9. The teeter totter apparatus of claim 8, further comprising a caster assembly, the caster assembly coupled with the base portion, and including a caster base portion along an x-y plane, including a plurality of caster base holes for fixing the caster base portion to the base portion, and a caster yoke portion rotationally coupled with the caster base portion about a king pin, allowing rotation of the caster yolk portion about a first axis, the caster yoke including a first and second substantially parallel yoke side portions including respective first and second caster yoke pivot pin holes;

where the beam portion includes at least one beam hole, the at least one beam hole capable of being aligned with the first and second caster holes, where the beam portion is coupled with the base portion by coupling the beam portion with the castor assembly using a pivot pin disposed through the first and second castor holes and the at least one beam hole thereby fixing the beam portion to the caster yolk portion while allowing the beam portion to rotate about a second axis.

10. A teeter totter apparatus, comprising:

a base portion;

a lazy susan rotational bearing coupled with the base portion;

a yoke portion coupled with the lazy susan rotational bearing portion and including a pivot portion; and a beam portion coupled with the yoke portion at the pivot portion, including at least one seating portion, and including a friction reduction portion integrated at an underside of at least one end of the beam portion, the friction reduction portion comprising a curved surface, thereby reducing the friction between the beam portion and a surface on which the base portion rests when the beam portion contacts the surface while it is rotating about the first axis;

wherein the teeter totter apparatus is capable of rotating about a first axis while rotating about a second axis that is different than the first axis.

11. The teeter totter apparatus of claim 10 where the beam portion includes a channel, and further including an opposing seat adjustment portion, and a contracting mechanism, where the contracting mechanism couples the seat portion with the opposing seat adjustment portion and is disposed through the channel and sandwiches the beam portion between the seat portion and the opposing seat adjustment portion, such that when the contracting mechanism is in a loose state, friction is reduced between the seat portion, the opposing seat adjustment portion and the beam portion, thereby allowing the seating portion to be moveable along the beam portion, and when the contracting mechanism is in a taught state, the seat portion and the opposing seat adjustment portion are frictionally secured against the beam portion to prevent the seat portion from movement along the beam portion.

* * * * *